US009578729B2

(12) United States Patent
McGeoch

(10) Patent No.: US 9,578,729 B2
(45) Date of Patent: Feb. 21, 2017

(54) EXTREME ULTRAVIOLET SOURCE WITH DUAL MAGNETIC CUSP PARTICLE CATCHERS

(71) Applicant: PLEX LLC, Fall River, MA (US)

(72) Inventor: Malcolm W. McGeoch, Little Compton, RI (US)

(73) Assignee: PLEX LLC, Fall River, MA (US)

( * ) Notice: Subject to any disclaimer, the term of this patent is extended or adjusted under 35 U.S.C. 154(b) by 0 days.

(21) Appl. No.: 14/943,132

(22) Filed: Nov. 17, 2015

(65) Prior Publication Data

US 2016/0150625 A1 May 26, 2016

Related U.S. Application Data

(60) Provisional application No. 62/082,828, filed on Nov. 21, 2014.

(51) Int. Cl.
*H05G 2/00* (2006.01)

(52) U.S. Cl.
CPC ..... *H05G 2/005* (2013.01); *H05G 2/008* (2013.01)

(58) Field of Classification Search
CPC ..... H05G 2/005; H05G 2/008
USPC ..... 250/504 R
See application file for complete search history.

(56) References Cited

U.S. PATENT DOCUMENTS 7,271,401 B2 9/2007 Imai et al.
7,479,646 B2 1/2009 McGeoch
7,671,349 B2 3/2010 Bykanov et al.
7,705,333 B2 4/2010 Komori et al.
7,999,241 B2 * 8/2011 Nagai ..... G03F 7/70033 250/423 R
8,143,606 B2 3/2012 Komori et al.
8,198,615 B2 6/2012 Bykanov et al.
8,269,199 B2 9/2012 McGeoch
8,440,988 B2 5/2013 McGeoch
8,492,738 B2 7/2013 Ueno et al.
8,507,883 B2 8/2013 Endo et al.
8,519,366 B2 8/2013 Bykanov et al.
8,569,723 B2 10/2013 Nagai et al.
8,569,724 B2 10/2013 McGeoch
8,586,953 B2 11/2013 Komori et al.
8,586,954 B2 11/2013 Asayama et al.
8,592,788 B1 11/2013 McGeoch
8,629,417 B2 1/2014 Nagai et al.
(Continued)

OTHER PUBLICATIONS

M. Richardson et al., "High conversion efficiency mass-limited Sn-based laser plasma source for extreme ultraviolet lithography", J. Vac. Sci. Tech. B, vol. 22, No. 2, Mar./Apr. 2004, pp. 785-790.
(Continued)

*Primary Examiner* — Wyatt Stoffa
*Assistant Examiner* — Eliza Osenbaugh-Stewart
(74) *Attorney, Agent, or Firm* — Wolf, Greenfield & Sacks, P.C.

(57) ABSTRACT

A laser-produced plasma extreme ultraviolet source has a buffer gas to slow ions down and thermalize them in a low-temperature plasma. The plasma is initially trapped in a mirror magnetic field configuration with a low magnetic field barrier to axial motion. Plasma overflows axially at each end of the mirror into magnetic cusps and is conducted by radial magnetic field lines to annular beam dumps disposed around the waist of each cusp.

4 Claims, 5 Drawing Sheets

(56) References Cited

U.S. PATENT DOCUMENTS

| | | | | |
|---|---|---|---|---|
| 8,710,475 | B2 | 4/2014 | Komori et al. | |
| 9,155,178 | B1 | 10/2015 | McGeoch | |
| 2011/0170079 | A1 | 7/2011 | Banine et al. | |
| 2011/0284775 | A1* | 11/2011 | Ueno | G03F 7/70033 250/504 R |
| 2014/0021376 | A1 | 1/2014 | Komori et al. | |

OTHER PUBLICATIONS

Y. Shimada et al., "Characterization of extreme ultraviolet emission from laser-produced spherical tin plasma generated with multiple laser beams", Appl. Phys. Lett., 86, 051501 (2005).
S. Fujioka et al., "Opacity Effect on Extreme Ultraviolet Radiation from Laser-Produced Tin Plasmas", Phys. Rev. Lett., 95, 235004 (2005).
S. Fujioka et al., "Pure-tin microdroplets irradiated with double laser pulses for efficient and minimum-mass extreme-ultraviolet light source production", Appl. Phys. Lett. 92, 241502 (2008).
H. Mizoguchi et al., "Sub-hundred Watt operation demonstration of HVM LPP-EUV Source", Proc. of SPIE, vol. 9048, 90480D-1, 2014.
D.C. Brandt et al., "LPP EUV Source Readiness for NXE 3300B", Proc. of SPIE, vol. 9048, 90480C-1, 2014.
M. McGeoch, "Progress on the Lithium EUV Source for HVM", Sematech Intl. EUVL Symposium, Toyama, Japan, Oct. 6-10, 2013, pp. 1-56.
H. Mizoguchi et al., "Performance of One Hundred Watt HVM LPP-EUV Source", Proc. Sematech Intl. Symposium on EUV Lithography, Washington DC, Oct. 27-29, 2014, 31 pages.
M.W. McGeoch, "Power Scaling of the Tin LPP Source via an Argon Cusp Plasma", Proc. Sematech Intl. Symposium on EUV Lithography, Washington DC, Oct. 27, 2014, 41 pages.

* cited by examiner

EXTREME ULTRAVIOLET SOURCE WITH DUAL MAGNETIC CUSP PARTICLE CATCHERS

CROSS REFERENCE TO RELATED APPLICATION

This application claims priority based on Provisional Application Ser. No. 62/082,828, filed Nov. 21, 2014, which is hereby incorporated by reference in its entirety.

FIELD OF THE INVENTION

This invention relates to the production of extreme ultraviolet (EUV) light especially at 13.5 nm for lithography of semiconductor chips. Specifically it describes configurations of the laser-produced-plasma (LPP) light source type that have improved particle capture and increased plasma heat removal for scaling to ultimate power.

BACKGROUND OF THE INVENTION

There is a need for more powerful sources of extreme ultraviolet (EUV) light at 13.5 nm in order to increase the throughput of semiconductor patterning via the process of EUV Lithography. Many different source designs have been proposed and tested (see historical summary for background [1]) including the highly efficient (up to 30%) direct discharge (DPP) lithium approach [2, 3, 4, 5, 6, 7] and also laser-plasma (LPP) irradiation of tin-containing [8] or pure tin droplets [9, 10, 11]. Laser irradiation of tin droplets has been the subject of intensive recent development [12, 13], particularly in the pre-pulse variant [11], which has a demonstrated efficiency of 4% and a theoretical efficiency of up to 6%.

In both lithium DPP and tin LPP approaches it is necessary to keep metal atoms from condensing on the collection mirror that faces the EUV-emitting plasma. Also, in the tin LPP approach, but not with lithium DPP, there are fast ions ranging up to 5 keV that have to be stopped otherwise the collection mirror suffers sputter erosion. The design of a successful EUV source based on a metal vapor must strictly protect against deposition on the collector of even 1 nm of metal in days and weeks of operation, and this factor provides the most critical constraint on all of the physics that can occur in a high power source.

Many magnetic field configurations have been discussed [14-29], with and without a buffer gas, to trap and exhaust tin ions. Methods have been proposed [14, 30, 31] to further ionize tin atoms so that they may be controlled by an applied magnetic field.

The symmetrical magnetic mirror trap [15, 18] has a limited cross sectional area for plasma exhaust toward each end, implying a very high concentration of plasma heat at each end where particle traps have to condense the working substance of the LPP source, usually tin. The condensation surfaces may become coated with tin during operation, and there can be sputtering of tin atoms associated with the impact of plasma tin ions that are accelerated toward the condensation surface by a plasma sheath potential. In one typical example, with a low hydrogen pressure to moderate the sheath potential [34] there can be $Sn^{3+}$ ions falling through a 12 volt sheath potential to deliver a sputter energy of 36 eV. It is possible that some of these sputtered tin atoms are able to cross the magnetic field to reach the adjacent part of the collection mirror, reducing collection efficiency, an effect reported by Mizoguchi et al. [15].

SUMMARY OF THE INVENTION

It is an object of the present invention to provide dual magnetic cusp particle catchers that also function as plasma beam dumps within the EUV source to allow a higher power to be handled than in prior art at the same time as shielding the collection mirror from the plasma impact area. One configuration to achieve this is illustrated in FIG. 1. With reference to that Figure, the central guide magnetic field provided by coils 30 and 40 is opposed at each end by oppositely directed coils 50 and 60 respectively that create two magnetic cusps. All of the coils are circular and are aligned on magnetic field axis 2 of rotational symmetry. The "waist" of each cusp, where the plasma particles exhaust, is close to cylindrical beam dump surface 140 that surrounds axis 2 and is concentric with it. At the outer end of each cusp, coils 50 and 60, respectively, generate a high magnetic field that stops axial plasma motion and sends plasma particles radially toward beam dumps 140. A high plasma power can be handled by each beam dump because the incident plasma has a line topology in contrast to the plane-point topology of prior art with no cusps. What is more, the lines of plasma intersection at the surfaces of beam dumps 140 may be positioned so as not to have any direct line of sight to the collection mirror, thereby providing protection to the mirror from sputtered tin atoms. Additional operating details of this first embodiment are provided below.

It is a further object of the present invention to replace outer coils 50 and 60 with a single magnetic system comprising a single coil and a yoke of high permeability material such as iron. An embodiment of this is shown in FIG. 2 in which coil 160 drives a magnetic field in yoke 150.

This design may incorporate an inflow of buffer gas, preferably hydrogen, to serve the following purposes:

1) Sufficient buffer gas density (approximately 5 Pa if the gas is hydrogen) degrades the energy of tin ions from the laser-plasma interaction, until they are thermalized at low energy (several eV) within the mirror trap and its ending cusp traps. The resultant low plasma temperature depresses the sheath voltage between the plasma and the beam dump surfaces, reducing ion impact energies and sputtering;
2) Fresh buffer gas flows past the collection mirror surface to sweep away neutral tin atoms that otherwise would pass through the magnetic field without deflection and deposit on the mirror;
3) The buffer gas within the mirror and cusp traps dilutes the tin density via continual replenishment to prevent tin buildup and consequent EUV absorption;
4) The buffer gas plasma outflow from the cusp traps carries both the tin ions and the vast majority of process heat down pre-determined magnetic field lines onto the plasma beam dumps. In this it is aided by the large heat capacity of metastable and ionic buffer gas species;
5) If the buffer gas is molecular hydrogen, it will partly dissociate into atomic hydrogen when within the tin exhaust plasma. This radical may then scavenge tin from surfaces such as the EUV collection mirror and the beam dump surface, forming the volatile tin hydride stannane.
6) In some circumstances the plasma outflow can contribute a vacuum pump action with a well-defined direction toward each of the plasma beam dumps.

Accordingly we propose a laser-produced plasma extreme ultraviolet light source comprising: a chamber; a source of droplet targets; one or more lasers focused onto the droplets in an interaction region; a flowing buffer gas; one or more reflective collector elements to redirect extreme ultraviolet light to a point on the collector optical axis which is an exit port of the chamber; a mirror magnetic plasma trap comprising a section of approximately parallel magnetic field lines through the interaction region terminated at each end by a magnetic cusp; and a cylindrical plasma beam dump disposed around the axis of each cusp to act as particle catchers and energy sinks for the system.

DETAILED DESCRIPTION

Figure 1:
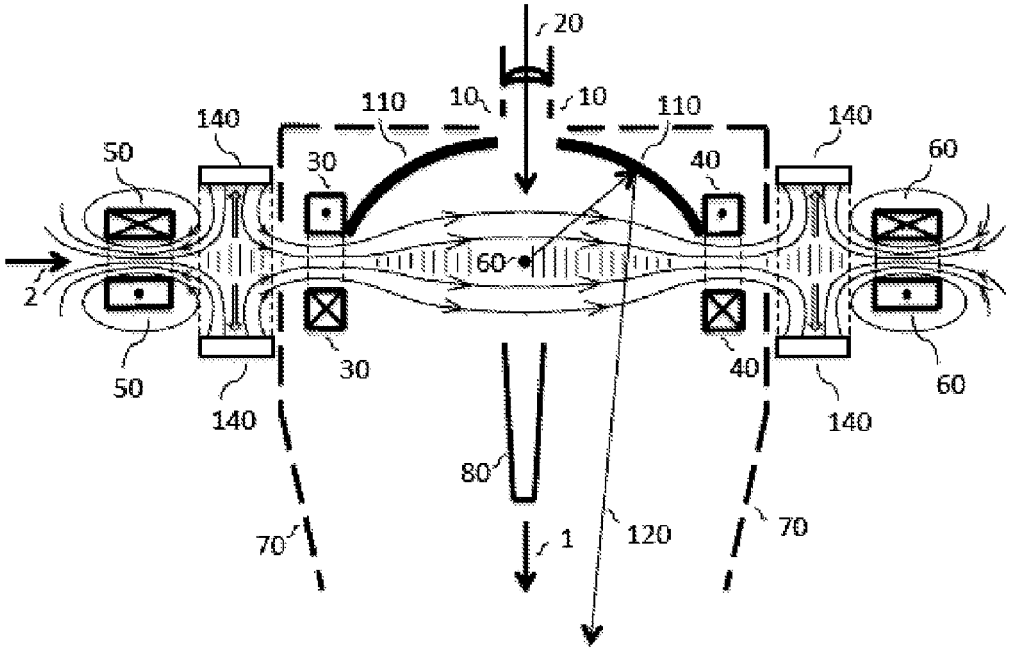
FIG. 1 illustrates the two-cusp particle catcher magnetic field configuration, one cusp at each end of the central mirror trap. The magnetic field coils have rotational symmetry around horizontal symmetry axis 2 and the collection optical system has rotational symmetry around vertical symmetry axis 1.

We describe the magnetic field configuration with reference to FIG. 1. The laser/plasma interaction occurs at central position 60. The laser beams 20 that are necessary to expand and heat incoming droplets may be delivered along the axis of chamber 70, shown as a dashed outline. Chamber 70 has rotational symmetry around symmetry axis 1. For times when droplets are not present, or the target is missed, there is a beam dump 80 for the laser beams. In this drawing the tin droplet stream and catcher for unused droplets are not shown. They may be positioned is several ways, one of which will be shown in FIG. 5. Also symmetrical around axis 1 is the EUV collection mirror 110 which has a central hole to admit the laser beams. A typical ray of EUV light 120 leaves the interaction position 60, reflects off mirror 110 and proceeds to the chamber exit point on axis 1, a position referred to as the "intermediate focus" between the source optic and the stepper illuminator optic. The magnetic field configuration in FIG. 1 has rotation symmetry around axis 2 that runs perpendicular to axis 1. It comprises a central, approximately parallel set of field lines generated by the aligned currents in coils 30 and 40. Within the cross section of each winding the direction of current flow is shown by a dot for current coming out of the page and an X for current flowing into the page.

Outboard of coils 30 and 40 lie coils 50 and 60, respectively, that carry currents opposed to those in 30 and 40 in order to create magnetic null points at each end, these null positions being the center of two magnetic cusps. The radial cusp fields, perpendicular to axis 2, intersect beam dumps 140 that are cylindrical and axially aligned on axis 2. In this manner, the exhaust particles and heat from interaction point 60 are directed by the magnetic field onto lines around the inside of beam dumps 140, to spread the particle and heat load over a large area on each. The field at the center of coils 50 and 60 is higher than elsewhere in the configuration, causing a blocking action.

Figure 3:
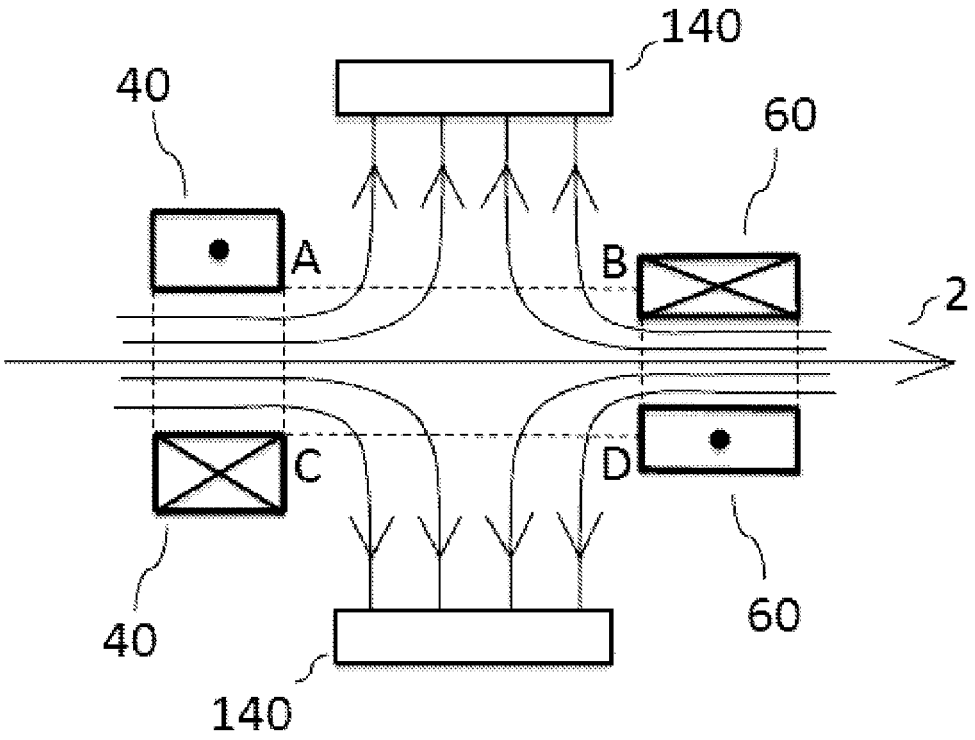
FIG. 3 illustrates the radial and axial magnetic fields within either of the cusp regions.
Figure 4:
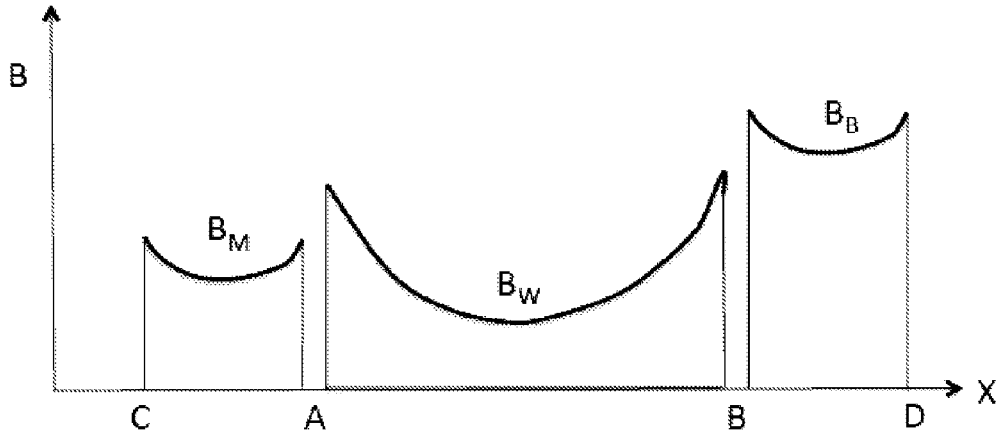
FIG. 4 shows the relative magnitude of magnetic field strength around a cusp.

More detail on the central region of the particle catcher cusps is given in FIG. 3. In that figure coils 40 and 60 correspond to those labeled 40 and 60 in FIG. 1. The magnetic field variation along lines AB, AC and BD of FIG. 3 is shown qualitatively in FIG. 4 where X represents distance along the labeled lines. The field within coil 60 has a central value $B_B$ lying on axis 2 between points B and D. This is a high blocking field that shunts plasma particles back toward the cusp central null points. Field $B_B$ exceeds the central value $B_M$ at the mirror exit half way between A and C. In turn the value $B_M$ exceeds value $B_W$ at the cusp waist between A and B. When the cusp axial fields $B_B$ and $B_M$ both exceed its radial field $B_W$ in this manner, then radial plasma leakage dominates at the circle of positions defined by all possible locations of the center of line AB around rotation axis 2. Plasma outflow from this locus then follows radial field lines toward the inside of cylindrical plasma beam dump 140.

Figure 2:
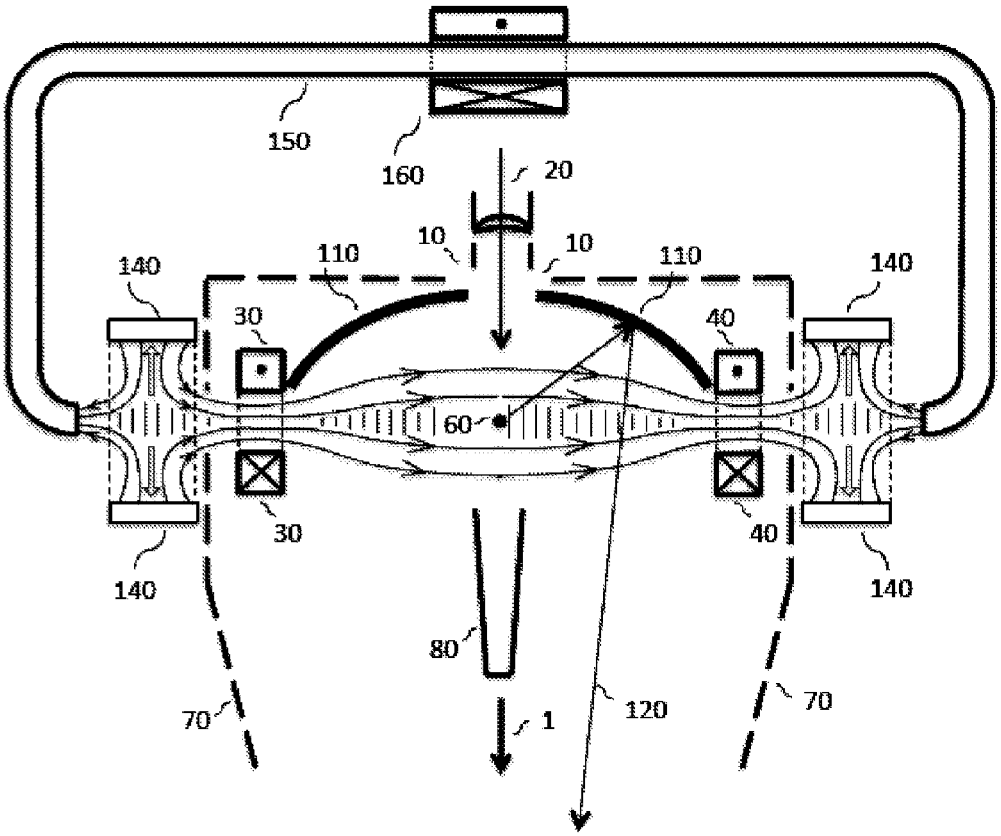
FIG. 2 shows the outer cusp coils of FIG. 1 replaced by a single coil and yoke of permeable material.

A further embodiment of the invention is shown in FIG. 2. This is functionally the same magnetic configuration as in FIG. 1 with the difference that field coils 50 and 60 are substituted by a single coil 160 that creates a high magnetic field in yoke 150 of high permeability material. The cusp fields are generated by field lines emanating from the end surfaces of yoke 150. This embodiment reduces the number of superconducting coils from 4 to 3, and also gives much better access for the vacuum manifolds that are shown in FIG. 5.

Figure 5:
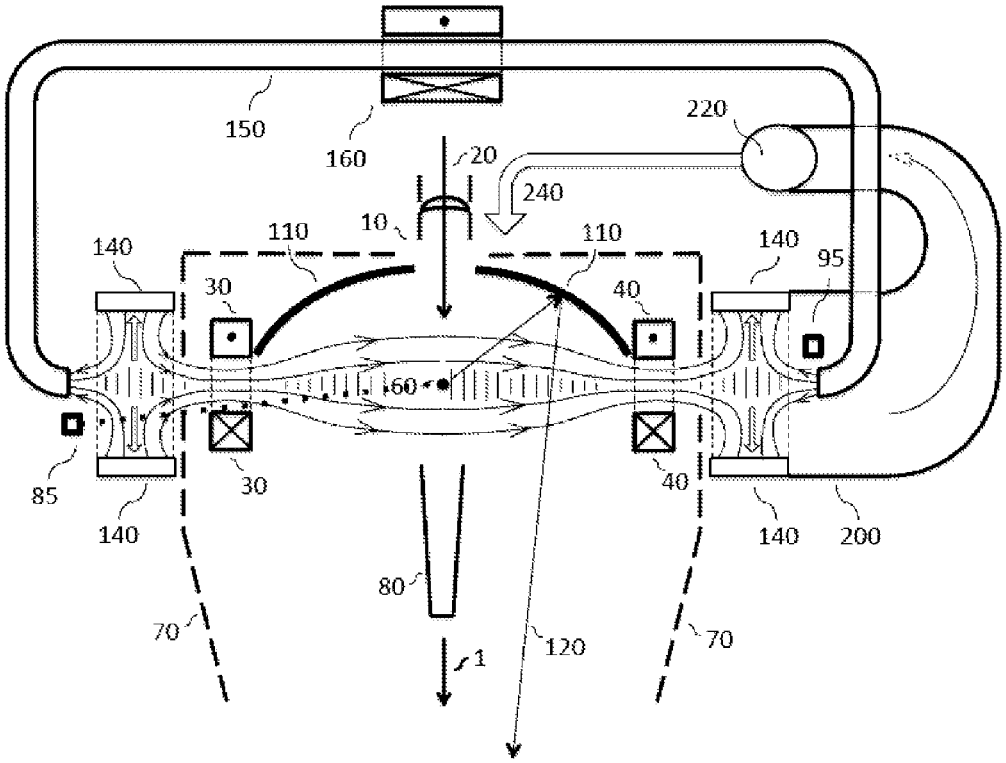
FIG. 5 shows additional system components including the droplet generator and gas re-circulation.

With the above description of the mirror and cusp fields in place, we show in FIG. 5 the disposition of several further elements of the EUV source. The outline of a vacuum chamber 70 is shown. Axis of rotational symmetry 1 defines the symmetry axis of chamber 70. Set into the wall of chamber 70 is droplet source 85 that delivers a stream of material in approximately 20 micron diameter droplets at a high velocity (order of 200 $msec^{-1}$) toward interaction location 60. Droplets that are not used are captured in droplet collector 95 at the opposite side of the chamber. Entering on the chamber axis is a laser beam (or beams) 20 that propagate through a hole in the center of collection mirror 110 toward interaction region 60, where laser energy is absorbed by a droplet and highly ionized species emit 13.5 nm EUV light. For example, the $CO_2$ laser at 10.6 micron wavelength has been found to be effective [11] with tin droplets for conversion to EUV energy, with 4% conversion demonstrated into 2% bandwidth light centered at 13.5 nm in $2\pi$ steradians [11]. Laser light that is not absorbed or scattered by a droplet is captured in beam dump 80. EUV light emitted from region 60 is reflected by collection optic 110 to propagate as typical ray 120 toward the chamber exit port for EUV. Collection optic 110 has rotational symmetry around axis 1. The chamber is shown truncated at the bottom in FIG. 5, but it continues until reaching the apex of the cone defined by converging walls 70 and rotation axis 1. At that position, known as the "intermediate focus" or IF, the beam of EUV light is transferred from chamber 70 via a port into the vacuum of the stepper machine.

In prior work [11] the laser has been applied as two separate pulses, a pre-pulse and a main pulse, where the pre-pulse evaporates and ionizes the tin droplet and the main pulse heats this plasma ball to create the high ionization states that yield EUV photons. When the pre-pulse is a picosecond laser pulse it ionizes very effectively [12] and creates a uniform pre-plasma to be heated by the main pulse, which is of the order of 10-20 nsec duration. Complete ionization via the pre-pulse is a very important step toward capture of (neutral) tin atoms which, if not ionized, will not be trapped by the magnetic field and could coat the collection optic. The pre-pulse laser may be of shorter wavelength than the main pulse laser in order to couple the laser-induced shock better into the tin droplet.

The buffer gas (chosen from the list hydrogen, helium or argon) may be introduced at location 10 and then flow through the central hole in the mirror. Alternatively it may be introduced at another location, or several locations in the wall of chamber 70. Its main function is to moderate the energy of exhaust tin ions leaving interaction region 60 at energies up to 5 keV. These ions are trapped by the magnetic field lines, but need to have frequent collisions in order to lose energy. The plasma density without added buffer gas would be too low to moderate tin ion energies before they reached the beam dumps, so that a high sheath voltage would exist at collectors 140 and damaging ion impact energies would occur. The equation governing this system is given in [34]. Only a modest buffer density, roughly in the range 1 Pa to 20 Pa is sufficient to greatly reduce tin ion impact energies. This buffer density can help to catch tin atoms and prevent them reaching the collector, but as the buffer gas becomes ionized its greater role is to provide a sufficient electron density to ionize these neutral tin atoms and put them again under control of the magnetic guide field.

With reference to FIG. 5, the exhaust gases are pumped by vacuum manifold 200 and pass through vacuum pump and cleaning/processing unit 220 before being returned via line 240 to re-enter chamber 70. A second vacuum manifold behind the opposite cusp is not shown for reasons of space.

REFERENCES

1. "EUV Sources for Lithography" Ed V. Bakshi, SPIE Press, Bellinghaven, Wash. 2005.
2. U.S. Pat. No. 7,479,646 McGeoch, Jan. 20, 2009
3. U.S. Pat. No. 8,269,199 McGeoch, Sep. 18, 2012
4. U.S. Pat. No. 8,440,988 McGeoch, May 14, 2013
5. U.S. Pat. No. 8,569,724 McGeoch, Oct. 29, 2013
6. U.S. Pat. No. 8,592,788 McGeoch, Nov. 26, 2013
7. M. McGeoch Proc. Sematech Intl. EUV Lithography Symp., Toyama, Japan 28$^{th}$ Oct. 2013
8. M. Richardson et al., J. Vac. Sci. Tech. 22, 785 (2004)
9. Y. Shimada et al., Appl. Phys. Lett. 86, 051501 (2005)
10. S. Fujioka et al., Phys. Rev. Lett. 95, 235004 (2005)
11. S. Fujioka et al., Appl. Phys. Lett. 92, 241502 (2008)
12. H. Mizoguchi et al, Proc SPIE 2014
13. D. Brandt et al., Proc SPIE 2014
14. M. W. McGeoch, U.S. patent application Ser. No. 14/317,280 "Extreme Ultraviolet Source with Magnetic Cusp Plasma Control", Jun. 27, 2014.
15. H. Mizoguchi et al., "Performance of one hundred watt HVM LPP EUV Source", Proc. Sematech Intl. Symposium on EUV Lithography, Washington D.C., Oct. 27, 2014.
16. U.S. Pat. No. 7,271,401 Imai et al., Sep. 18, 2007
17. U.S. Pat. No. 7,705,333 Komori et al., Apr. 27, 2010
18. U.S. Pat. No. 7,999,241 Nagai et al, Aug. 16, 2011
19. U.S. Pat. No. 8,143,606 Komori et al., Mar. 27, 2012
20. U.S. Pat. No. 8,492,738 Ueno et al., Jul. 23, 2013
21. U.S. Pat. No. 8,507,883 Endo et al., Aug. 13, 2013
22. U.S. Pat. No. 8,569,723 Nagai et al., Oct. 29, 2013
23. U.S. Pat. No. 8,586,953 Komori et al., Nov. 19, 2013
24. U.S. Pat. No. 8,586,954 Asayama et al., Nov. 19, 2013
25. U.S. Pat. No. 8,629,417 Nagai et al., Jan. 14, 2014
26. U.S. Pat. No. 8,710,475 Komori et al., Apr. 29, 2014
27. U.S. Pat. No. 8,519,366 Bykanov et al., Aug. 27, 2013
28. US Pat Appl. 20140021376 Komori et al., Jan. 23, 2014
29. US Pat Appl. 20110170079 Banine et al, Jul. 14, 2011
30. U.S. Pat. No. 7,671,349 Bykanov et al., Mar. 2, 2010
31. U.S. Pat. No. 8,198,615 Bykanov et al., Jun. 12, 2012
32. M. W. McGeoch, "Power Scaling of the Tin LPP Source via an Argon Cusp Plasma", Proc. Sematech Intl. Symposium on EUV Lithography, Washington D.C., Oct. 27$^{th}$ (2014).

The invention claimed is:

1. An extreme ultraviolet light source comprising: a chamber; a source of droplet targets; one or more lasers focused onto the droplets in an interaction region; a flowing buffer gas; one or more reflective collector elements to redirect extreme ultraviolet light to a point on the collector optical axis which is an exit port of the chamber; a pair of similar polarity field coils that generate a parallel magnetic field through the interaction region with magnetic symmetry axis perpendicular to the optical axis; a pair of opposed field coils outside of the first pair that generate cusps with magnetic null points on the magnetic axis; a pair of cylindrical beam dumps coaxial with the magnetic axis that intercept the radial outflow from the cusps, wherein waste heat and exhaust particles are able to escape from magnetic confinement at the cusp waists and are intercepted by the beam dumps.

2. An extreme ultraviolet light source as in claim 1 in which a buffer gas chosen from the set hydrogen, helium and argon is flowed through the chamber at a density sufficient to slow down fast ions from the laser-plasma interaction, but not absorb more than 50% of the extreme ultraviolet light as it passes from the plasma region to an exit port of the chamber.

3. An extreme ultraviolet light source as in claim 2 in which a hydrogen buffer is provided in the density range between $2\times10^{14}$ and $5\times10^{15}$ atoms $cm^{-3}$.

4. An extreme ultraviolet light source as in claim 1 in which the parallel magnetic field within the interaction region has a strength in the range 0.2 T to 2 T.

* * * * *